United States Patent [19]

Maekawa et al.

[11] Patent Number: 4,524,117

[45] Date of Patent: Jun. 18, 1985

[54] ELECTROPHOTOGRAPHIC METHOD FOR THE FORMATION OF TWO-COLORED IMAGES

[75] Inventors: Kouji Maekawa, Kyoto; Mamoru Kato, Osaka; Syoji Nakagama, Osaka; Yumiko Sano, Osaka, all of Japan

[73] Assignee: Mita Industrial Co., Ltd., Osaka, Japan

[21] Appl. No.: 621,090

[22] Filed: Jun. 15, 1984

[30] Foreign Application Priority Data

Jun. 30, 1983 [JP] Japan ..... 58-120587

[51] Int. Cl.[3] ..... G03G 13/01

[52] U.S. Cl. ..... 430/44; 430/45; 430/55; 355/4

[58] Field of Search ..... 430/45, 44; 355/4

[56] References Cited

U.S. PATENT DOCUMENTS 3,748,125 7/1973 Hercock et al. ..... 430/45

4,007,045 2/1977 Ishida et al. ..... 430/44

*Primary Examiner*—John D. Welsh

*Attorney, Agent, or Firm*—Lyon & Lyon

[57] ABSTRACT

An electrophotographic method for the formation of two-colored images comprising: (1) uniformly charging the surface of a photoreceptor having a conductive substance and a photoconductive layer formed on the conductive substance, said photoconductive layer being sensitive to a first color, (2) exposing a two-colored original, to form on said photoconductive layer an electrostatic latent image, which corresponds to a second color region in the original, with the same polarity as the electric charges on the surface of said photoconductive layer, (3) subjecting the surface of said photoreceptor to a reversal development treatment by the use of a photoconductive color toner charged with the same polarity as the electric charges constituting said electrostatic latent image, to develop the non-charged region with the photoconductive color toner, (4) subjecting said electrostatic latent image to a normal development treatment by the use of an insulative toner having a color different from the color of said photoconductive color toner, and (5) charging the color toners on said photoconductive layer with a different polarity from the charging polarity in process (1) and simultaneously exposing said original through a filter shielding against said first color, thereby providing a practical method for the formation of a desired two colored distinct image corresponding to the original.

7 Claims, 5 Drawing Figures

ELECTROPHOTOGRAPHIC METHOD FOR THE FORMATION OF TWO-COLORED IMAGES

BACKGROUND OF THE INVENTION

1. Field of the Invention

The present invention relates to an electrophotographic method for the formation of distinct images having two colors, using a simple means.

2. Description of the prior art

In order to emphasize particular portions in documents, conference materials or the like printed by a color ink such as black, corrections, comments and underlines are made on the original document material or the like by the use of colored pencils (e.g., red pencils) which are distinguishable from the basic color (i.e., black) of the original. However, once the original documents or materials are copied by a copying machine to distribute to subscribers, conference members, etc., such corrections, comments and underlines are reproduced in black only, so that the corrections, comments and underlines no longer appear to be emphasized. The colors to be used for such corrections, comments or underlines do not usually have to correspond to the colors in the original, but they are required to be distinguishable from the basic color of the original.

For this purpose, various methods for the formation of two-colored images ave been proposed in, for example, U.S. Pat. No. 4,189,224 and U.S. Pat. No. 4,413,899 both of which are patented to Ricoh Co. Ltd., Japan. However, in these proposed methods, a special structured photosensitive layer such as photosensitive lamination comprising two photoconductive layers of different spectral sensitivities is essential, and alternatively, a special exposure filter can be employed instead of the multi-structured photosensitive layer. These conventional methods require expensive and complicated technology so that they cannot be put into practical use.

SUMMARY OF THE INVENTION

The electrophotographic method for producing two-colored images of this invention which overcomes the above-discussed disadvantages of the prior art, comprises:

(1) uniformly charging the surface of a photoreceptor having a conductive substance and a photoconductive layer formed on the conductive substance, said photoconductive layer being sensitive to a first color, (2) exposing a two-colored original, to form on said photoconductive layer an electrostatic latent image, which corresponds to a second color region in the original, with the same polarity as the electric charges on the surface of said photoconductive layer, (3) subjecting the surface of said photoreceptor to a reversal development treatment by the use of a photoconductive color toner charged with the same polarity as the electric charges constituting said electrostatic latent image, to develop the non-charged region with the photoconductive color toner, (4) subjecting said electrostatic latent image to a normal development treatment by the use of an insulative toner having a color different from the color of said photoconductive color toner, and (5) charging the color toners on said photoconductive layer with a different polarity from the charging polarity in process (1) and simultaneously exposing said original through a filter shielding against said first color.

The exposure in process (2) may be carried out through a filter transmitting the first color.

The preferred photoconductive color toner is of a two-component developer system having a sensitivity to any color wavelength other than at least the first color wavelength. The photoconductive color toner comprises pigments, resin binders, sensitizing agents, and toner-blocking agents.

The insulative toner mainly consists of, for example, carbon black.

The normal development may be carried out using a non-contact development. The non-contact development is a toner projection development ("jumping" development), a touch-down development, a powder cloud development or the like.

Thus, the invention described herein makes possible the objects of providing a simple and inexpensive electrophotographic method for the formation of a two-colored image wherein one of the desired two colored toners is a photoconductive color toner and a photoconductive layer is used which has a sensitivity to one of the desired two colors in the original thereby simply and easily forming an image having two colors by the use of a known photoconductor, a known insulative toner and a known photoconductive toner for electrophotography; providing an electrophotographic method for the formation of a two-colored image which is easily put into practical use; and providing an electrophotographic method for the formation of a distinct image having the desired two colors.

BRIEF DESCRIPTION OF THE DRAWINGS

This invention may be better understood and its numerous objects and advantages will become apparent to those skilled in the art by reference to the accompanying drawings as follows:

FIG. 1(*b*) is a schematic illustration showing the first light-exposing process of the present invention.

FIG. 1(*c*) is a schematic illustration showing the reversal development process of the present invention.

FIG. 1(*d*) is a schematic illustration showing the normal development process of the present invention.

FIG. 1(*e*) is a schematic illustration showing the second charging and light-exposing process of the present invention.

DESCRIPTION OF THE PREFERRED EMBODIMENTS

The arrangement, function and effects of the invention will now be described with reference to the drawings showing embodiments of the invention. The following illustrates the most typical examples, but it is to be understood that these are not intended to limit the scope of the invention and that changes and modifications thereof are within the technical scope of the invention.

Figure 1:
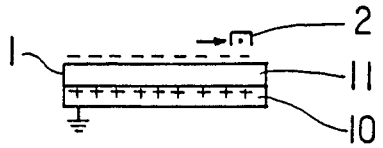
FIG. 1(*a*) is a schematic illustration showing the first charging process of the present invention.
Figure 1:
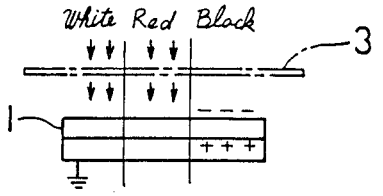
Figure 1:
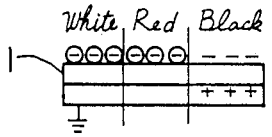
Figure 1:
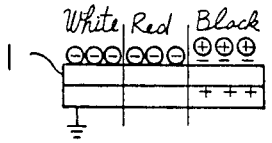
Figure 1:
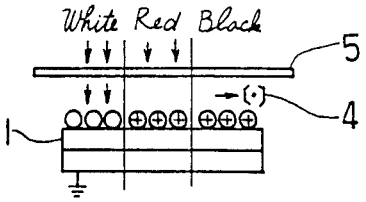

According to the present invention, as shown in FIG. 1(*a*), the surface of a photoreceptor 1 for electrophotography is uniformly subjected to a first positive or negative charging treatment (e.g., negative charging, hereinafter) by means of a first corona charger 2. The photoreceptor 1 comprises a conductive substance 10 and a photoconductive layer 11 formed on the conductive substance 10.

As the conductive substrate 10, known conductive substrates for electrophotography may be used, examples of which are foil, a plate, a sheet or drum of a metal such as aluminum, copper, tin or tinplate. Moreover, a substrate prepared by disposing a metal such as mentioned above on a film base such as a bi-axially stretched polyester film or a glass sheet by vacuum evaporation deposition, sputtering or non-electrolytic plating may be used. NESA glass as the conductive substrate may also be used.

As the photoconductive layer 11, known photosensitive materials having a sensitivity to the given color, for example, a red color can be used. Examples includes substances which are made of an inorganic substance such as selenium, a selenide containing As, Te, or other elements, zinc oxide, or the like; or an organic substance such as polyvinyl carbazole or the like.

This first charging process is carried out depending upon the charging characteristic of the photoconductive layer 11. When the photoconductive layer 11 is a P-type semiconductor, its surface is positively charged, while when it is a N-type semiconductor its surface is negatively charged resulting in an inducement of positive electric charges in the conductive substance 10.

Then, as shown in FIG. 1(*b*), an original document having two colors is subjected to a exposure treatment to cause photoconduction in the regions on the photoconductive layer 11 corresponding to a white background and a first color (e.g., red color) region in the original, resulting in the migration of negative electric charges in these regions on the photoreceptor 1 through the conductive substance 10 and the formation of an electrostatic latent image with negative electric charges on the photoreceptor 1 corresponding to a second color (e.g., black color) region in the original. For an easy understanding with respect to the colors in the original, the first color region is indicated as red; the second color region is indicated as black; and the white background is indicated as white in FIGS. 1(*b*) to 1(*e*). The above-mentioned exposure may be carried out through a filter transmitting red light to the regions on the photoreceptor 1 corresponding to the red and white regions in the original creating a balanced uniformed sensitivity between the red and white regions of the original, thereby forming a distinct electrostatic latent image on the photoreceptor 1.

Then, as shown in FIG. 1(*c*), the photoreceptor 1 is subjected to a known reversal development treatment by the use of a photoconductive color toner (e.g., a photoconductive red toner) with the same negative polarity as the electric charges constituting the electrostatic latent image, thereby forming a red toner layer on the non-charged regions in the photoreceptor 1 which correspond to the white background and the red region in the original. As the photoconductive red toner, a photoconductive toner of a two-component developer system which has a sensitivity to any color wavelength other than at least the red color wavelength, can be used. Such toners are well known in the art, comprising pigments, resin binders, sensitizing agents, and toner-blocking agents. The pigments are made of, for example, a red pigment such as red iron oxide, cadmium red, fast red, red lead, or the like; and a photoconductive pigment such as a perylene pigment, zinc oxide, or the like. Examples of the resin binders areo polyester resin epoxy resin, or the like. Examples of the sensitizing agents are a basic dyestuff such as Rhodamine B, or a Lewis acid such as quinones (e.g., P-chloranil, anthraquinone), nitro-aromatics (e.g., 1.3.5-trinitrobenzene, P-nitrophenol), or the like. As the blocking agents, silica, aluminum, talc, or the like may be used. Although the two colors in the final image are not required to correspond to the two colors in the original, respectively, they are required to be distinguishable from each other, and thus the color of the photoconductive color toner may be any kind of chromatic color other than black and not limited to the red color.

Then, as shown in FIG. 1(*d*), the formed electrostatic latent image corresponding to the black region in the original is subjected to a normal development treatment by the use of an insulative color toner which is positively charged differing from the polarity of the electrostatic latent image. The color toner is colored by a different color (e.g., black) from the photoconductive red toner in the above-mentioned reversal development process. As the black toner, an insulative toner such as carbon black can be used. Normal development binds the black toner to the electrostatic latent image on the photoreceptor 1. The development may be carried out in combination with a known non-contact development such as a "jumping" development, a touch-down development or a powder cloud development, in order that the black toner will not affect the red-toner image which has already been developed on the photoreceptor 1 corresponding to the white and the red regions in the original.

Then, as shown in FIG. 1(*e*), the developed toner layer in the whole region on the photoreceptor 1 is subjected to a second exposure treatment by means of a second corona charger 4 with a positive polarity which is different from the first negative charging polarity. Simultaneously, the original is exposed through a filter 5 shielding against red light. Due to the simultaneous charging and exposure treatment, the black and the red toners on the photoreceptor 1, which are respectively attached to the black and the red regions on the photoreceptor 1 corresponding to the original, are positively charged due to the following phenomena:

The red light does not reach the red toner image on the photoreceptor 1 corresponding to the red region in the original due to the red-light-shielding filter 5, so that the photoconductive red toner thereon cannot be rendered photoconductive and is finally positively charged with positive electric charges by the second corona charger 4. The positive polarity of the insulative black toner on the photoreceptor 1 corresponding to the black region in the original is maintained due to its insulative characteristic despite the second charging treatment, while the red toner on the photoreceptor 1 corresponding to the white background in the original is rendered photoconductive, receiving white light transmitted through the filter 5. The portion of the photoconductive layer 11, which corresponds to the white background in the original and holds the photoconducted red toner thereon, is also rendered photoconductive due to its own charging characteristic, resulting in the migration of the positive electric charges thereof through the conductive substance 10. As a result, the negative electric charges of the red toner on the region corresponding to the white region in the original are neutralized with positive electric charges from the second corona charger 4, and the red toner on the corresponding white region is no longer charged.

Thus, on each region corresponding to the red and the black regions in the original, the red and the black toners, both of which are positively charged with the same polarity, are respectively disposed. On the remaining region on the photoreceptor 1 corresponding to the white background in the original, non-charged red toner is disposed.

On the resulting toner image, a transfer paper is then disposed. As soon as the back of the transfer paper is negatively charged by a transfer charger (not shown), the positively charged toners are electrostatically transferred to the transfer paper, while the non-charged toner on the photoreceptor 1 corresponding to the white background in the original is not transferred to the transfer paper, resulting in the formation of the desired two-colored (e.g. red and black) image which corresponds to the colors in the original.

The photoreceptor 1 is then subjected to a known toner-cleaning treatment by means of a cleaning blade to prepare for the next image formation process.

What is claimed is:

1. An electrophotographic method for the formation of two-colored images comprising:

(1) uniformly charging the surface of a photoreceptor having a conductive substance and a photoconductive layer formed on the conductive substance, said photoconductive layer being sensitive to a first color, (2) exposing a two-colored original, to form on said photoconductive layer an electrostatic latent image, which corresponds to a second color region in the original, with the same polarity as the electric charges on the surface of said photoconductive layer, (3) subjecting the surface of said photoreceptor to a reversal development treatment by the use of a photoconductive color toner charged with the same polarity as the electric charges constituting said electrostatic latent image, to develop the non-charged region with the photoconductive color toner, (4) subjecting said electrostatic latent image to a normal development treatment by the use of an insulative toner having a color different from the color of said photoconductive color toner, and (5) charging the color toners on said photoconductive layer with a different polarity from the charging polarity in process (1) and simultaneously exposing said original through a filter shielding against said first color.

2. A method according to claim 1, wherein said exposure in process (2) is carried out through a filter transmitting the first color.

3. A method according to claim 1, wherein said photoconductive color toner is of a two-component developer system having a sensitivity to any color wavelength other than at least the first color wavelength.

4. A method according to claim 3, wherein said photoconductive color toner comprises pigments, resin binders, sensitizing agents, and toner-blocking agents.

5. A method according to claim 1, wherein said insulative toner mainly consists of carbon black.

6. A method according to claim 1, wherein said normal development is carried out using a non-contact development.

7. A method according to claim 6, wherein said non-contact development is a toner projection development, a touch-down development, or a powder cloud development.

* * * * *